US007165351B2

(12) United States Patent
Church

(10) Patent No.: US 7,165,351 B2
(45) Date of Patent: Jan. 23, 2007

(54) MUZZLE LOADER

(76) Inventor: Douglas W. Church, 145 Erie St., Salamanca, NY (US) 14779

( * ) Notice: Subject to any disclaimer, the term of this patent is extended or adjusted under 35 U.S.C. 154(b) by 26 days.

(21) Appl. No.: 11/043,757

(22) Filed: Jan. 25, 2005

(65) Prior Publication Data

US 2006/0162218 A1 Jul. 27, 2006

(51) Int. Cl.
*F41C 9/08* (2006.01)

(52) U.S. Cl. ..... 42/51; 89/1.3

(58) Field of Classification Search ..... 42/51, 42/90; 89/1.3, 27.13
See application file for complete search history.

(56) References Cited

U.S. PATENT DOCUMENTS 4,152,858 A * 5/1979 Dobbs ..... 42/90
4,229,897 A 10/1980 Snowden
4,442,620 A 4/1984 Drake et al.
4,466,209 A * 8/1984 Strickland et al. ..... 42/90
4,550,517 A * 11/1985 Mansfield ..... 42/90
4,607,446 A 8/1986 Scheuring
4,862,623 A * 9/1989 Delap et al. ..... 42/90
5,081,781 A * 1/1992 Kanyuck et al. ..... 42/90
5,097,615 A 3/1992 Kearns
5,109,623 A * 5/1992 French ..... 42/90
5,182,412 A * 1/1993 Mazza ..... 42/90
6,865,840 B1 * 3/2005 Kanyuck et al. ..... 42/90
6,918,201 B1 * 7/2005 Guillory ..... 42/51
6,981,345 B1 * 1/2006 Gunn et al. ..... 42/90

* cited by examiner

*Primary Examiner*—Michael J. Carone
*Assistant Examiner*—Bret Hayes
(74) *Attorney, Agent, or Firm*—Vincent G. Lotempio

(57) ABSTRACT

A device for loading powder and a projectile into the muzzle of a muzzle loading firearm. The device consists of a hollow cylindrical tubular body with a rod ("ball starter") attached for loading a firearm. The tubular body has an elongated bore or cavity that is preloaded with a measured quantity of powder and a bullet. The tubular body fits onto the barrel, with all elements in line with the barrel opening. To load the firearm, a pin which holds the powder and bullet in place must be pulled, and the ball starter pushes all the elements into the barrel, followed by a ramrod to prepare the rifle for firing. The pin is held by an elastic band outside the tubular body during loading and post loading it is removably repositioned and held in the cavity by the flexible band. The present invention includes a groove along its longitudinal side for storing the ball starter prior to use; the ball starter is held in place by a removable flexible band. In addition, cylindrical apertures in the side of the tubular body store additional primers. Finally, the opening that fits snugly over the barrel of the firearm is configured with an aperture that allows the device to fit securely over the front sight of the weapon.

11 Claims, 3 Drawing Sheets

FIG. 2
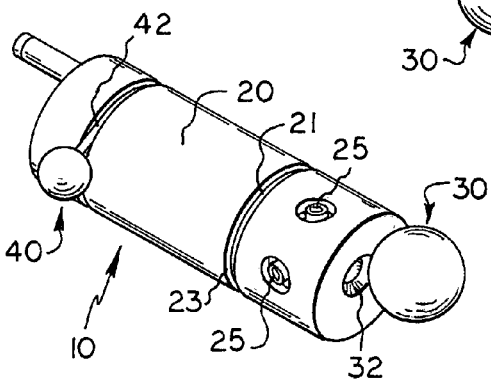
FIG. 1
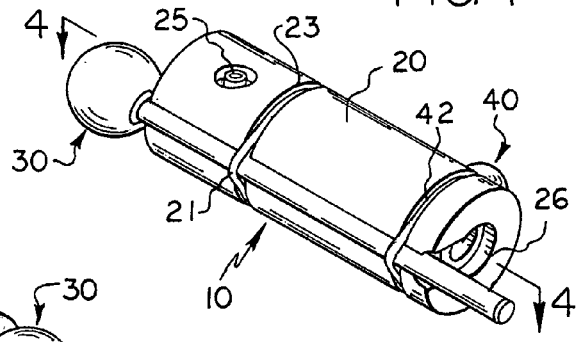
FIG. 3
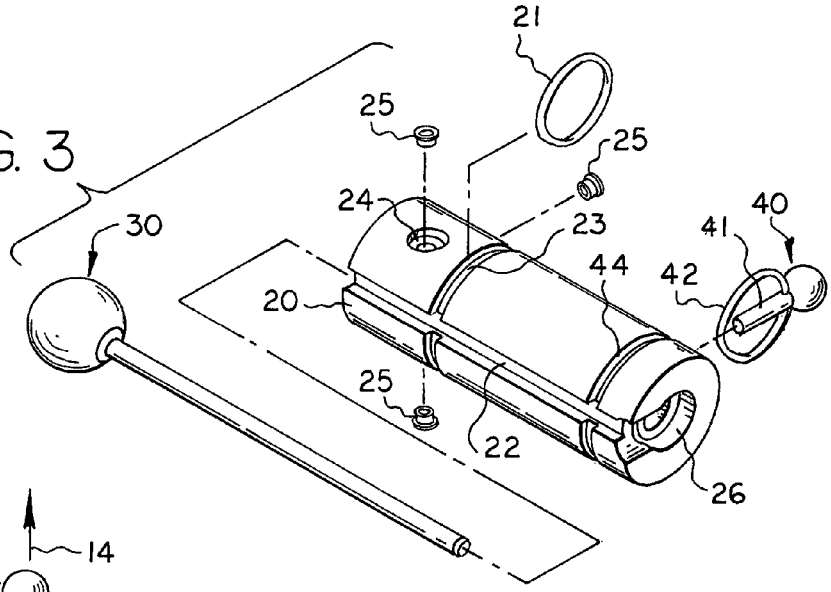
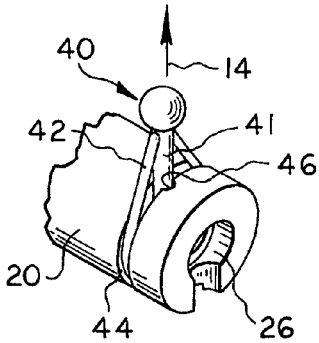
FIG. 5

MUZZLE LOADER

BACKGROUND OF THE INVENTION

1. Field of the Invention

This invention relates to loading and reloading of muzzle loading forearms. More particularly, the invention relates to a loading device that holds projectiles, powder and percussion caps for loading muzzle loading firearms, such as rifles and provides a manner of rapidly reloading the firearm for a second shot.

2. Background and Prior Art

Many people continue to muzzle-load firearms, such as rifles, due to the historical significance and long-range accuracy of the rifle and because hunting seasons are at times restricted to muzzle loaders. In order to muzzle-load a rifle, compressed powder pellets and a projectile, such as a bullet, must be loaded in the muzzle of the rifle, and a percussion cap must be placed on the nipple of the rifle. Thus, it is necessary for a person utilizing a muzzle-loading rifle to carry with him quantities of compressed powder pellets, bullets and percussion caps. While it is desirable to expedite the muzzle loading of such rifles, the procedures required to load the rifles cannot be automated without ruining the muzzle-loading concept. A problem associated with use of muzzle loading rifles in game hunting is the time required to reload under actual field conditions of use. A period typically of one to two minutes is required to assemble all the necessary items carried by the hunter and all components are individually inserted in the muzzle for charging with a ramrod for reloading. Moreover, certain prior art devices to facilitate the loading are not easily adaptable to muzzle loading rifles having barrels varying in shape and size.

Several devices have been invented to facilitate the loading of black powder, patches, projectiles and other components into a muzzle-loading firearm. U.S. Pat. No. 4,442,620, issued to S. C. Drake et al., discloses a multi-chambered system that employs a lever actuated spring-loaded slide system to release powder, patch and ball into the barrel of the firearm. U.S. Pat. No. 4,607,446, issued to M. W. Scheuring, discloses another multi-chambered system, employing corks to hold powder, patch and ball in the aperture prior to use, and a leather disk, attached to a hanging thong, to hold extra primers. This device is, inefficient and difficult to because of the necessity to carry primers in a separate device.

U.S. Pat. No. 5,097,615, issued to R. M. Kearns, discloses a single-chamber speed-loader employing an elongated tubular device containing the powder, patch and ball, and using a plunger to push these components into the barrel of the firearm.

U.S. Pat. No. 4,229,897, issued to J. C. Snowden, discloses a plunger-actuated device, employing a hinged block that lifts away for loading, and a sliding cover strip that holds the components in place prior to use. This invention does not overcome the problem and disadvantages of carrying ungainly devices, such as lengthy attached plungers as embodied in Snowden (or to carry an inadequate number of primers in the speed-loading device itself.) These muzzle loaders suffer the disadvantages of being relatively heavy, of loosely carrying bullets which cause noise due to the metal-to-metal contact of carrying only a single type of percussion cap and of not facilitating the carrying of a measured amount of powder charge to permit precise loading of a rifle.

Another disadvantage of prior art muzzle loaders is that they require the projectile to be placed in the muzzle of a firearm by hand.

SUMMARY OF THE INVENTION

The invention overcomes drawbacks in conventional techniques for loading muzzle loaded rifles by providing a device which holds all necessary items, the device being easily fitted to the barrel of the muzzle loaded rifle for deposition therein of a pre-measured charge of powder, and a ball. A component of the device provides a receptacle for holding a percussion cap for ready access as needed. With use of the device, reloading can be accomplished typically in a matter of a few seconds, reducing the time required under actual field hunting conditions to reload the muzzle loaded rifle after discharge of the rifle. Since the success of the hunter in striking game can depend upon rapid repetition of a shot which misses the game, the present invention can contribute materially to the success of a sportsman or hunter by permitting reloading and refiring before the game has escaped.

It is accordingly a primary object of the present invention to permit reloading of a muzzle loaded rifle quickly and expeditiously under field usage conditions.

Another object of the invention is to permit storage of a pre-measured quantity of compressed powder pellets, a bullet or projectile and percussion cap for rapid loading into the barrel of the rifle when needed.

Yet another object of the invention is to provide a muzzle loaded rifle loading device adaptable to fit the muzzle of muzzle loaded rifles having a raised gun sight on the barrel.

A further object of the invention is to provide a muzzle loaded rifle loading device which is relatively simple in construction, economically manufactured from common materials and tools, conveniently carried under actual field conditions, and operable repeatedly with little required maintenance.

Another further object of the invention is to provide a receptacle for holding a percussion cap to give the hunter dependable and ready access to a cap as needed under field conditions.

Additional objects and advantages will become apparent and a more thorough and comprehensive understanding may be had from the following description and claims taken in conjunction with the accompanying drawings forming a part of this specification.

BRIEF DESCRIPTION OF THE DRAWINGS

The present invention and the manner in which it may be practiced is further illustrated with reference to the accompanying drawings wherein:

FIG. 1 is a front perspective view of a muzzle-loading device of the present invention.

FIG. 2 is a front perspective view of a muzzle loader of the present invention showing the plunger entrance of the loader.

FIG. 3 is an exploded view of the muzzle-loading device of the present invention.

FIG. 5 is a partial perspective front view of the release pin being withdrawn from the muzzle loader body of a preferred embodiment of the present invention.

DETAILED DESCRIPTION OF THE INVENTION

Figure 4:
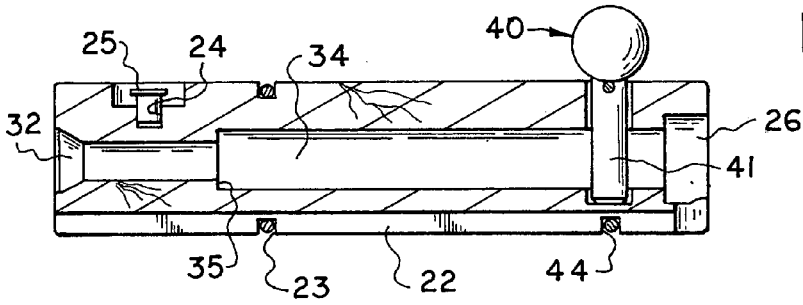
FIG. 4 is a cross-sectional view of the present invention, taken generally along line 4—4 in FIG. 1.

At the outset, it should be clearly understood that like reference numerals are intended to identify the same structural elements, portions, or surfaces consistently through out the several drawing figures, as may be further described or explained by the entire written specification of which this detailed description is an integral part. The drawings are intended to be read together with the specification and are to be construed as a portion of the entire "written description" of this invention as required by 35 U.S.C. § 112.

The present invention is a muzzle-loading device for a muzzle loading firearm comprised of a hollow tubular body with a ball starter rod removably attached for loading a firearm. In order to muzzle-load a rifle, compressed powder pellets and a projectile, such as a bullet or a ball, (firing elements) must be loaded in the muzzle of the rifle, and a percussion cap must be placed on the firing mechanism of the rifle. The interior of the muzzle-loading device is preloaded with the firing elements. The muzzle-loading device is placed on to the upraised barrel of the rifle with all elements in line with the barrel opening. To conclude loading, the release mechanism assembly which holds the powder, bullets, and primer in place is disengaged and the ball starter rod, is inserted into the hollow chamber of the muzzle-loading device, and the all the elements are pushed into the barrel of the rifle. Once the firing elements are in the barrel a conventional ram rod is pushed into the barrel to move the elements into firing position within the rifle.

Adverting now to the drawings, with reference to FIG. 1, a preferred embodiment of the accessory muzzle-loading device of the present invention is indicated generally by numeral 10. Muzzle-loading device 10 according to the present invention is formed of a substantially tubular body 20, ball starter rod 30 and a release mechanism assembly 40 as basic components. Tubular body 20 has a first end portion, a second end portion and a mid portion. Cylindrical bore 34 is an elongated longitudinal borehole through a mid portion of tubular body 20 extending from rod opening 32 (located at the first end portion as illustrated in FIG. 2) to notched opening 26 located at the second end portion. Notched opening 26 is configured to accept the end of the barrel of a muzzle loading rifle that is equipped with a gun sight that protrudes upwardly from the barrel of a rifle. Muzzle loader 10 has grooved wall 22 configured to removably hold ball starter rod 30 and grooved section 44 which accommodates elastic band 42 of release mechanism assembly 40, and grooved section 23 that extends radially around tubular body 20 to align and maintain elastic band 21 which in conjunction with elastic band 42 removably holds ball starter rod 30 within grooved wall 22. Circular grooves 24 (receptacles for holding and receiving various size percussion caps 25) are carved into the outer walls of tubular body 20 adjacent rod opening 32 as a percussion cap retention means to give the hunter reliable and ready access to a percussion cap as needed under field conditions. Although muzzle-loading device 10 is shown in FIG. 1 as a hollow tubular shape, it should be readily obvious to those of ordinary skill in the art that this device could be made in a substantially rectangular or irregular shape (not shown).

FIG. 3 is an exploded view of the muzzle-loading device of the present invention. Tubular body 20 has an elongated cylindrical bore as the ammunition cavity. Release mechanism assembly 40 is comprised of release pin 41 and band 42. Band 42 is configured to removably hold pin 41 in position and maintain the firing elements within the cylindrical borehole until the device is placed on the end of the rifle for loading. The band is made of elastic rubber material which allows the pin to be removed and then returned into position once the pin is released. Band 21 and band 42 are maintained within grooves 23 and 44 respectively. Together the bands removably hold ball starter rod 30 in position within groove 22. Ball starter rod 30 is a plunger used to push the contents of tubular body 20 (firing elements) into the muzzle of a firearm.

FIG. 4 is a cross-sectional view of the present invention, without the firing elements inside cylindrical bore 34, taken generally along line 4—4 in FIG. 1. Tubular body 20 has an elongated cylindrical bore 34 for receiving the firing elements, along with a plunger (ball starter rod 30) which can be pushed by a handle slidingly through the bore to load the compressed powder pellets and a projectile into the barrel of the muzzle loaded rifle. The elongated cylindrical bore is configured to narrow at a predetermined point (limiting wall 35) to keep the firing elements from falling out of the device but also remain open at rod opening 32 so that the plunger can be readily run through the longitudinal bore. The muzzle-loading device is provided with notched opening 26, a recess for fitting the device over the barrel of the upright muzzle loaded rifle with a gun sight so as to orient elongated cylindrical bore 34 directly over the muzzle of the rifle barrel. Means are provided for retaining a percussion cap in circular grooves 24 stamped into to the body of tubular body 20.

FIG. 5 is a partial perspective front view of the release pin being withdrawn from the muzzle loader body of a preferred embodiment of the present invention. Release pin 41 is pulled generally in the direction of arrow 14 clearing the cylindrical borehole allowing the firing elements to be placed into or released from the device. FIG. 5 also illustrates the shape of notched opening 26 which is arranged to accept the barrel of a rifle having a gun sight.

Figure 6:
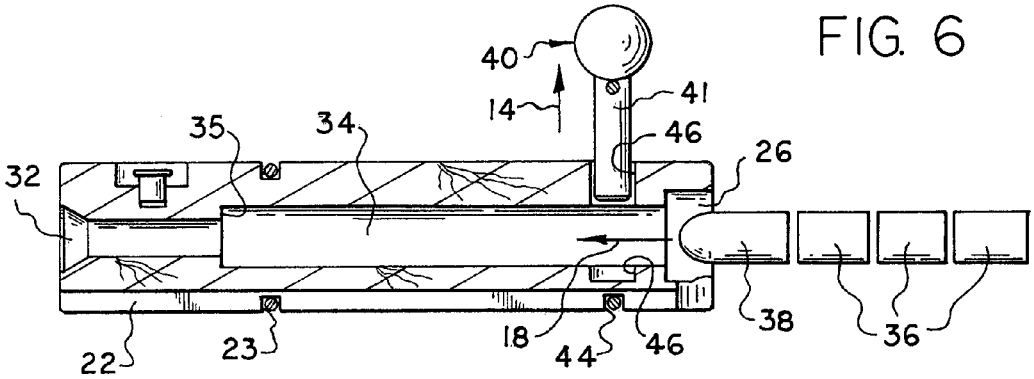
FIG. 6 is a cross-sectional view of the present invention, taken generally along line 4—4 in FIG. 1 with the release pin withdrawn from the lower body and a bullet with powder charges being loaded into the muzzle loader body.

FIG. 6 is a cross-sectional view of the present invention, taken generally along line 4—4 in FIG. 1 with release pin 41 withdrawn from cylindrical cavity 46 allowing a clear path for bullet 38 and powder charges 36 to be loaded into the body of the muzzle-loading device. Release pin 41 is pulled generally in the direction of arrow 14 clearing the cylindrical borehole allowing the firing elements to be moved generally in the direction of arrow 18 and thus placed into elongated cylindrical bore 34.

Figure 7:
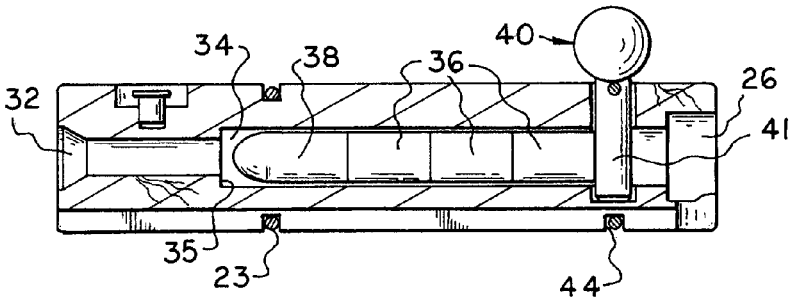
FIG. 7 is a cross-sectional view of the muzzle-loading device of the present invention, taken generally along line 4—4 in FIG. 1 with a bullet and powder charges loaded into the muzzle-loading device body.

FIG. 7 is a cross-sectional view of the present invention, taken generally along line 4—4 in FIG. 1 with the release pin engaged into the body of the device and with a bullet and powder charges loaded into elongated cylindrical bore 34 of the body muzzle-loading device. The bore is configured to hold the firing elements snugly in the chamber to avoid the creation of sound by movement within the chamber. The bore is also configured to allow the elements to slide freely out of the chamber and into a rifle at the loading time.

Figure 8:
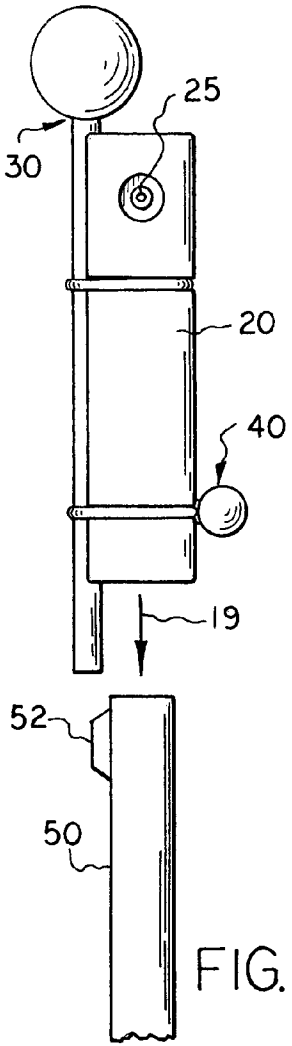
FIG. 8 is perspective view of a muzzle-loading device of the present invention positioned above the barrel of a rifle.

FIG. 8 is perspective view of muzzle-loading device of the present invention positioned over barrel 50 with a gun sight 52 of an upright muzzle loaded rifle so as to orient elongated cylindrical bore 34 directly over the muzzle of the rifle barrel. The muzzle-loading device is moved generally in the direction of arrow 19 aligning the device with the rifle.

Figure 9:
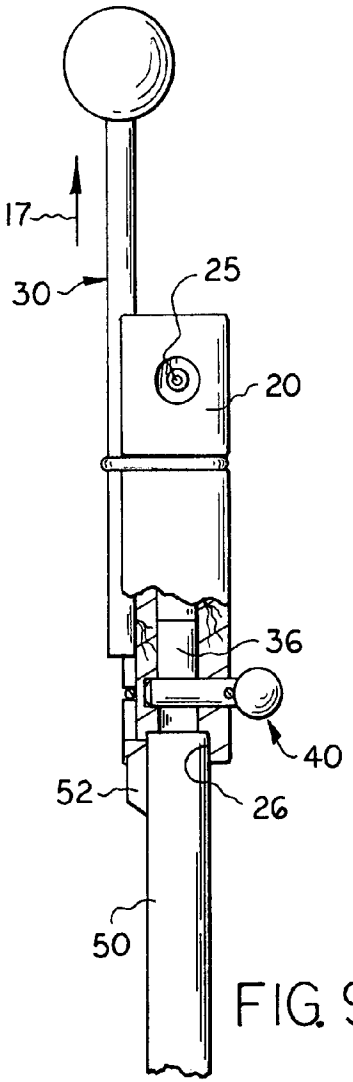
FIG. 9 is a partial broken away perspective view of a muzzle-loading device of the present invention positioned on the barrel of a rifle.

FIG. 9 is a partial broken away perspective view of a muzzle-loading device of the present invention positioned on the barrel of rifle 50. Release pin 41 is engaged and holding the ammunition within the device. The barrel of rifle 50 and gun sight 52 is enclosed by groove 26 so as to orient the elongated cylindrical bore 34 directly over the muzzle of the rifle barrel. Ball starter rod 30 is removed from muzzle-loading device generally in the direction of arrow 17.

Figure 10:
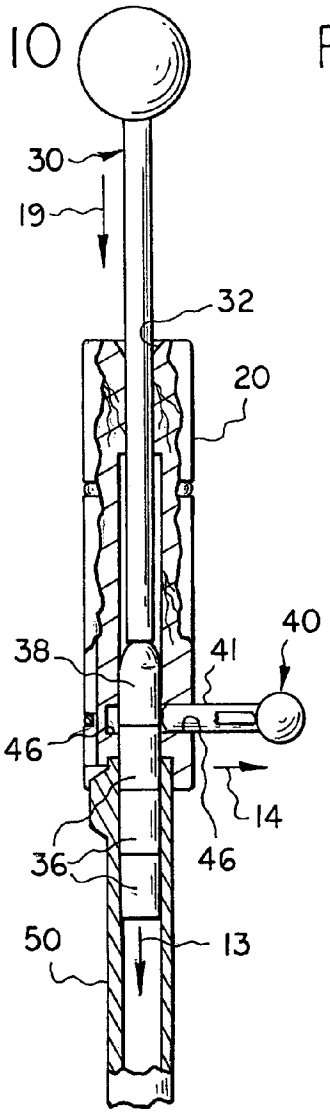
FIG. 10 is a broken away perspective view of a muzzle-loading device of the present invention positioned on the barrel of a rifle with the pin disengaged and the rod pushing the firing elements into the barrel of the rifle.

FIG. 10 is a broken away perspective view of a muzzle-loading device of the present invention positioned on the barrel of a rifle with the pin disengaged and the rod pushing the firing elements into the barrel of the rifle. Prior to pushing the elements into the barrel release pin 41 is pulled generally in the direction of arrow 14 clearing the cylindrical borehole allowing the firing elements to be moved generally in the direction of arrow 13 and thus placed into the barrel of rifle 50. Once release pin 41 is pulled, ball starter rod 30 is inserted into rod opening 32, the entrance to the hollow chamber housing the firing elements of the muzzle-loading device, and the all the firing elements are pushed into the barrel of the rifle.

Figure 11:
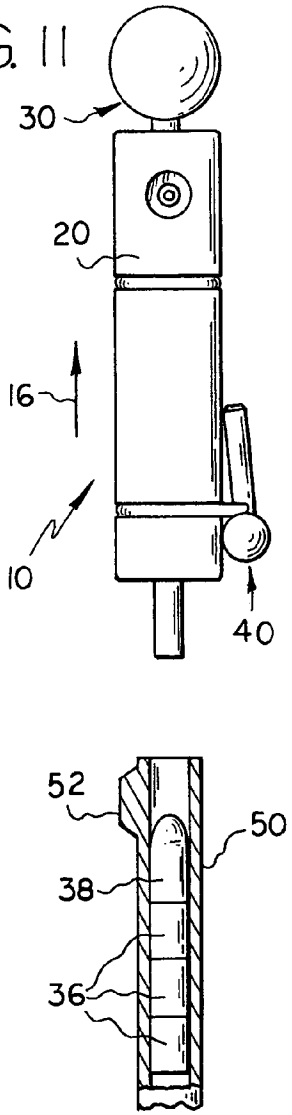
FIG. 11 is a perspective view of a muzzle loader of the present invention removed from the barrel of a rifle and a broken away perspective view of the barrel to show the charge waiting to be fully seated for firing.

FIG. 11 is a perspective view of a muzzle loader of the present invention removed from the barrel of a rifle generally in the direction of arrow 16 and a broken away perspective view of the barrel illustrating the charge waiting to be fully seated for firing. The firing elements are in position in the barrel for a conventional ram rod (not shown) to move the firing elements into firing position within the rifle. Starter rod 30 is pushed completely through elongated cylindrical bore 34 having cleared the firing elements from the device. Release pin 41 is operatively arranged with band 42 to pull free from cylindrical cavity 46 and remain flush against the outside face of the body. When release pin 41 is pulled it is held by the band outside the body during loading and post loading it is removably repositioned and held in the cavity by the flexible band.

Figure 12:
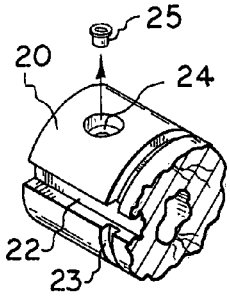
FIG. 12 is a partial perspective front view a primer withdrawn from the muzzle loader body of a preferred embodiment of the present invention.
Figure 13:
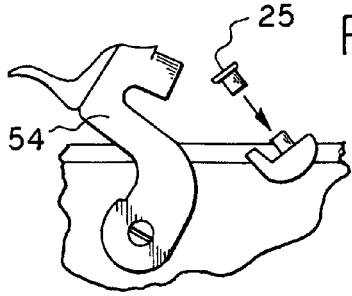
FIG. 13 is a partial perspective front view a primer loaded into the rifle.

FIG. 12 is a partial perspective front view primer 25 being withdrawn from the body of the muzzle-loading device. To conclude loading a muzzle-loaded rifle a percussion cap must be placed on the firing mechanism of the rifle. FIG. 13 is a partial perspective front view showing primer 25 prior to being loaded on the firing mechanism of the rifle in a position to be struck by hammer 54. In a preferred embodiment, the muzzle-loading device is made of wood, although any other material that will provide support for firing elements or the like can also be used, such as glass, metal, plastic, or rubber. Although the invention as been described with reference to certain preferred embodiments, it will be appreciated by those skilled in the art that modifications and variations may be made without departing from the spirit and scope of the invention. While a preferred form of this invention has been described above and shown in the accompanying drawings, it should be understood that applicant does not intend to be limited to the particular details described above and illustrated in the accompanying drawings, but intends to be limited only to the scope of the invention as defined by the following claims. In this regard, the term "means for" as used in the claims is intended to include not only the designs illustrated in the drawings of this application and the equivalent designs discussed in the text, but it is also intended to cover other equivalents now known to those skilled in the art, or those equivalents which may become known to those skilled in the art in the future.

What is claimed is:

1. A muzzle loading device for muzzle loading firearms, comprising:

a substantially tubular body having a mid portion; a first end portion; and a second end portion; wherein said mid portion is provided with an elongated bore to receive and hold firing elements; and each of said end portions is provided with an aperture;

a ball starter rod reciprocally receivable within the apertures of said end portions for pushing the contents of said body into the muzzle of a firearm;

a powder charge retention means; and a release mechanism assembly comprised of a pin removably positioned to block said elongated bore and an elastic band.

2. The muzzle loading device for muzzle loading firearms of claim 1, wherein said tubular body has a groove and an elastic band to removably hold said ball starter rod.

3. The muzzle loading device for muzzle loading firearms of claim 1 wherein said elongated bore has a limiting wall.

4. The muzzle loading device for muzzle loading firearms of claim 3, wherein said tubular body has at least one circular groove as a powder charge retention means to removably hold said powder charge.

5. The muzzle loading device for muzzle loading firearms of claim 3 wherein said pin is operatively arranged to removably remain outside said elongated bore when pulled from said body.

6. The muzzle loading device for muzzle loading firearms of claim 5 wherein said body is substantially rectangular.

7. The muzzle loading device for muzzle loading firearms of claim 5 wherein said body is made of wood.

8. The muzzle loading device for muzzle loading firearms of claim 5 wherein said aperture of said second end is configured to fit securely over a sight of said muzzle loading firearm.

9. The muzzle loading device for muzzle loading firearms of claim 8 wherein said device is made of plastic.

10. A muzzle loading device for muzzle loading firearms, comprising:

a substantially tubular body made of wood having a mid portion; a first end portion; and a second end portion; wherein said mid portion is provided with an elongated bore to receive and hold firing elements; and each of said end portions is provided with an aperture;

a ball starter rod reciprocally receivable within the apertures of said end portions for pushing the contents of said body into the muzzle of a firearm;

a groove and an elastic band to removably hold said ball starter rod to said substantially tubular body; a powder charge retention means comprised of a circular groove; and a release mechanism assembly comprised of a pin removably positioned to block said elongated bore and is operatively arranged to removably remain outside said elongated bore when pulled from said body.

11. The muzzle loading device for muzzle loading firearms of claim 10 wherein said body is substantially rectangular.

* * * * *